US011646131B2

(12) United States Patent
Gundel

(10) Patent No.: US 11,646,131 B2
(45) Date of Patent: May 9, 2023

(54) ELECTRICAL CABLE WITH STRUCTURED DIELECTRIC

(71) Applicant: 3M INNOVATIVE PROPERTIES COMPANY, St. Paul, MN (US)

(72) Inventor: Douglas B. Gundel, Cedar Park, TX (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 17/261,725

(22) PCT Filed: Aug. 12, 2019

(86) PCT No.: PCT/IB2019/056837
§ 371 (c)(1),
(2) Date: Jan. 20, 2021

(87) PCT Pub. No.: WO2020/035773
PCT Pub. Date: Feb. 20, 2020

(65) Prior Publication Data

US 2021/0257126 A1 Aug. 19, 2021

Related U.S. Application Data

(60) Provisional application No. 62/718,103, filed on Aug. 13, 2018.

(51) Int. Cl.
*H01B 7/08* (2006.01)
*H01B 11/00* (2006.01)
(Continued)

(52) U.S. Cl.
CPC ..... *H01B 7/0861* (2013.01); *H01B 7/0838* (2013.01); *H01B 11/002* (2013.01); *H01B 11/1895* (2013.01); *H01B 11/203* (2013.01)

(58) Field of Classification Search
CPC ... H01B 5/02; H01B 5/04; H01B 7/02; H01B 7/0861; H01B 7/0838; H01B 11/02; H01B 11/002; H01B 11/1895; H01B 11/203
(Continued)

(56) References Cited

U.S. PATENT DOCUMENTS 3,244,799 A * 4/1966 Roberts ..... H01B 7/28 174/107
3,496,281 A * 2/1970 McMahon ..... H01B 11/1834 174/29
(Continued)

FOREIGN PATENT DOCUMENTS

EP 3503126 A2 * 6/2019 ..... H01B 11/20
WO WO 1993-006604 4/1993
(Continued)

OTHER PUBLICATIONS

International Search Report for PCT International Application No. PCT/IB2019/056837, dated Dec. 13, 2019, 5 pages.

*Primary Examiner* — William H. Mayo, III
(74) *Attorney, Agent, or Firm* — Jonathan L. Tolstedt

(57) ABSTRACT

A cable includes a plurality of substantially parallel conductors extending along a length of the cable and generally lying in a plane of the conductors, and a dielectric film having a plurality of pairs of structures, and folded upon itself along a longitudinal fold line so that the structures in each pair of structures face, and are aligned with, each other, each conductor of the plurality of conductors disposed between the structures in a corresponding pair of structures.

19 Claims, 13 Drawing Sheets

(51) Int. Cl.
*H01B 11/18* (2006.01)
*H01B 11/20* (2006.01)

(58) Field of Classification Search
USPC ..... 174/110 R, 113 R, 117 R, 117 F
See application file for complete search history.

(56) References Cited

U.S. PATENT DOCUMENTS

| | | | | |
|---|---|---|---|---|
| 10,892,069 | B2 * | 1/2021 | Gundel | H01B 7/0838 |
| 2007/0205008 | A1 | 9/2007 | Witthoft | |
| 2014/0027150 | A1 * | 1/2014 | Gundel | H01B 11/1856 174/102 R |
| 2016/0019998 | A1 | 1/2016 | Kawaguchi et al. | |
| 2016/0247603 | A1 * | 8/2016 | Gundel | G02B 6/4429 |
| 2018/0025805 | A1 * | 1/2018 | Gundel | H01B 7/0838 174/102 R |
| 2019/0198199 | A1 * | 6/2019 | Gundel | H01B 7/0838 |

FOREIGN PATENT DOCUMENTS

| | | |
|---|---|---|
| WO | WO 2012-138717 | 10/2012 |
| WO | WO 2012-138729 | 10/2012 |
| WO | WO 2014-074269 | 5/2014 |
| WO | WO 2016-080522 | 5/2016 |

* cited by examiner

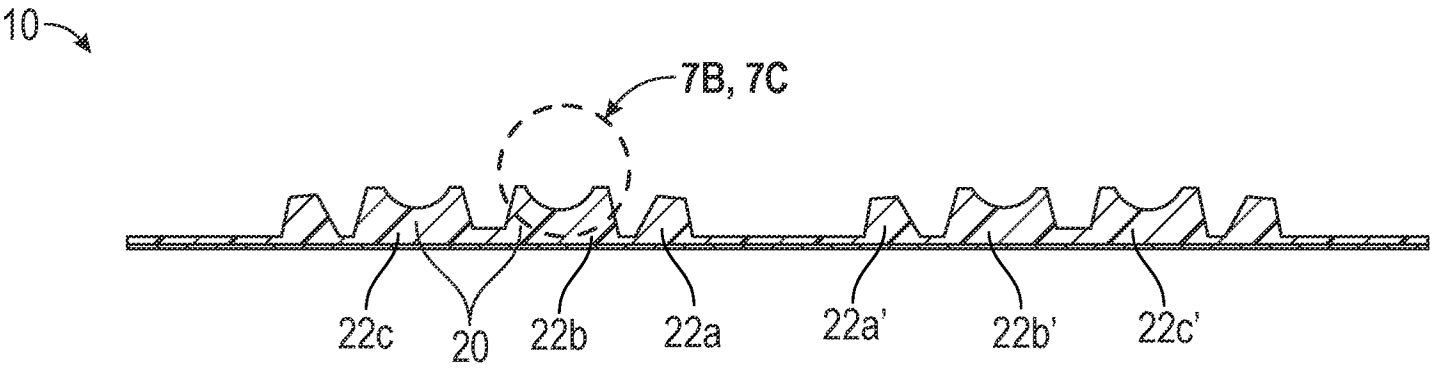
FIG. 7A
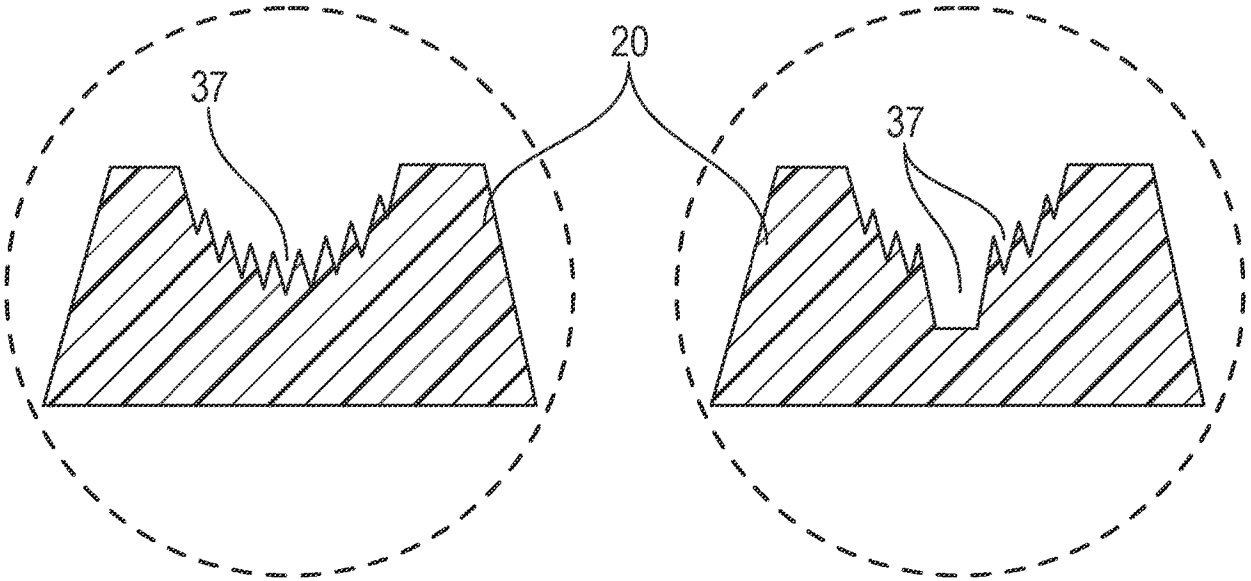
FIG. 7B
FIG. 7C

ELECTRICAL CABLE WITH STRUCTURED DIELECTRIC

CROSS REFERENCE TO RELATED APPLICATIONS

This application is a national stage filing under 35 U.S.C. 371 of PCT/IB2019/056837, filed Aug. 12, 2019, which claims the benefit of provisional Application No. 62/718,103, filed Aug. 13, 2018, the disclosure of which is incorporated by reference in its/their entirety herein.

BACKGROUND

Electrical cables for transmission of electrical signals are well known. One common type of electrical cable is a coaxial cable. Coaxial cables generally include an electrically conductive wire surrounded by an insulating material. The wire and insulator are surrounded by a shield, and the wire, insulator, and shield are surrounded by a jacket. Another common type of electrical cable is a shielded electrical cable that includes one or more insulated signal conductors surrounded by a shielding layer formed, for example, by a metal foil.

SUMMARY

In some aspects of the present description, an electrical cable is described, including a plurality of substantially parallel conductors extending along a length of the cable and generally lying in a plane of the conductors, and a dielectric film including a plurality of pairs of structures and folded upon itself along a longitudinal fold line so that the structures in each pair of structures face, and are aligned with, each other, each conductor of the plurality of conductors disposed between the structures in a corresponding pair of structures.

In some aspects of the present description, an electrical cable is described, including a plurality of substantially parallel conductors extending along a length of the cable and generally lying in a plane of the conductors, a first dielectric film including a first plurality of structures, and a second dielectric film including a second plurality of structures. The second dielectric film is disposed on and substantially coextensive with the first dielectric film, such that each structure in the first plurality of structures faces and is substantially aligned with a corresponding structure in the second plurality of structures to create pairs of structures, each conductor of the plurality of conductors disposed between the structures in each pair of structures, where the structures in each pair of structures, in combination, cover at least 40% of a periphery of the conductor.

In some aspects of the present description, a ribbon cable is described, including a plurality of conductor sets extending along a length of the ribbon cable and generally lying in a plane of the ribbon cable, a first bonding film disposed on a top side of the plurality of conductor sets, and a second bonding film disposed on a bottom side of the plurality of conductor sets. The first bonding film is bonded to the second bonding film such that the conductor sets are captured between and substantially surrounded by the first bonding film and second bonding film. Each conductor set includes a plurality of substantially parallel conductors extending along a length of the conductor set and generally lying in a plane of the conductors, and a dielectric film including a plurality of pairs of structures, and folded upon itself along a longitudinal fold line so that the structures in each pair of structures face, and are aligned with, each other, each conductor of the plurality of conductors disposed between the structures of a single corresponding pair of structures.

BRIEF DESCRIPTION OF THE DRAWINGS

FIGS. 7A-7C present cross-sectional views of the support structures of a structured dielectric film;

DETAILED DESCRIPTION

Figure 1:
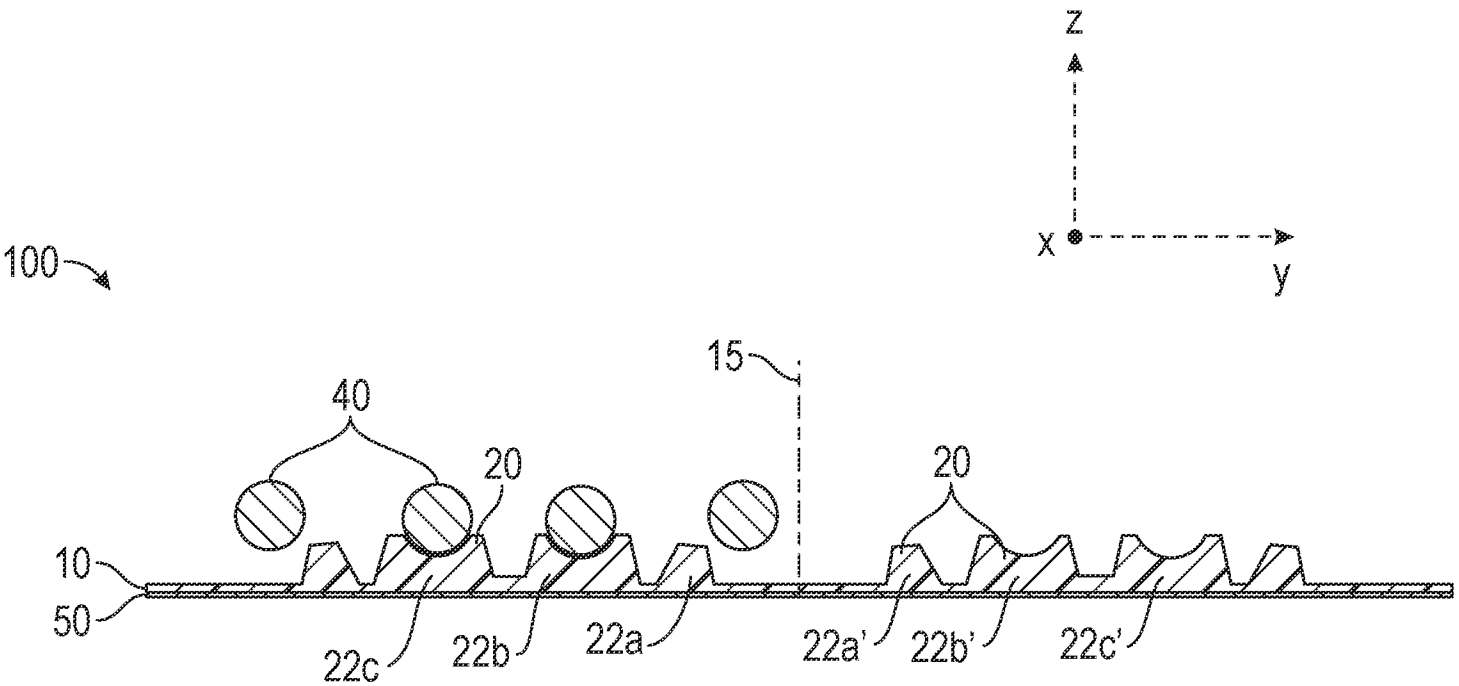
FIG. 1 is a cross-sectional view of an electrical cable.

In the following description, reference is made to the accompanying drawings that form a part hereof and in which various embodiments are shown by way of illustration. The drawings are not necessarily to scale. It is to be understood that other embodiments are contemplated and may be made without departing from the scope or spirit of the present description. The following detailed description, therefore, is not to be taken in a limiting sense.

According to some aspects of the present description, electrical cables incorporating the layers and structures described herein have been found to provide improved performance over conventional cables. For example, the electrical cables may have one or more of a reduced impedance variation along the cable length, lower skew, lower propagation delay, lower insertion loss, increased crush resistance, reduced cable size, increased conductor density, and improved bend performance compared to conventional cables. In addition, manufacturing processes for the construction of electrical cables such as those described herein have been found to be simplified and/or more cost effective when compared to manufacturing processes used in the production of conventional cables.

In some embodiments, an electrical cable is constructed by creating a structured dielectric that maintains a geometrical structure and arrangement of a set of electrical conductors to achieve certain improvements in performance. These improvements may include, but are not limited to, maintaining a consistent impedance along the cable length, incorporating air into the structure of the electrical cable to decrease size and increase density, as well as to decrease the dielectric constant of the cable, and providing a high mechanical resistance to local impedance change with externally applied force and strains like bending. Specifically, since the primary bending plane of the cable is the same as the wire plane with a portion of the wires occupying the neutral axis, there can be optimum configurations that allow air inclusion in some of the structure, while providing deformation resistance in bending. The design of the electrical cable herein also provides a means to create the structures and apply them to the conductors and complete the construction with an outer conductive shield surrounding the cable.

In some embodiments, a ribbon cable is constructed including a plurality of conductor sets extending along a length of the ribbon cable and generally lying in a plane of the ribbon cable, a first bonding film disposed on a top side of the plurality of conductor sets, and a second bonding film disposed on a bottom side of the plurality of conductor sets. The first bonding film may be bonded to the second bonding film such that the plurality of conductor sets is captured between and substantially surrounded by the first bonding film and second bonding film to create a ribbon cable. Each conductor set in the ribbon cable may include a plurality of substantially parallel conductors extending along a length of the conductor set and generally lying in a plane of the conductors, and a dielectric film. The dielectric film may include a plurality of pairs of structures, and the dielectric film may be folded upon itself along a longitudinal fold line so that the structures in each pair of structures face, and are aligned with, each other. Each conductor of the plurality of conductors is disposed between the structures of a single corresponding pair of structures.

In some embodiments, the structured dielectric may be a created as a microreplicated film including a series of pairs of structures which extend along the length of the dielectric film. The structured dielectric film may then be folded upon itself along one or more longitudinal fold lines such that it substantially surrounds and encloses a set of electrical conductors. The structures in each pairs of structures face each other and are aligned with each other, such that each conductor in the set of electrical conductors is disposed between the corresponding structures in a single pair of structures. The shape and size of the structures are such that the structures of a single pair of structures cradle a conductor and prevent any lateral movement of the conductors.

For the purposes of this specification, microreplication shall refer to the process of replicating a pattern of microscale structures onto a substrate. In some embodiments, the microscale structures may be precisely-sculpted microscopic shapes placed on a substrate or backing layer to form cells or air voids. In other embodiments, the microscale structures may be molded or formed into an insulative layer using microreplication techniques and/or micromolds to create support structures or air voids.

The structured dielectric film described herein may have a low dielectric constant and/or low dielectric loss (e.g., low effective loss tangent). For example, the arrangement, size, and spacing of the structures on the dielectric film may be such that the resulting electrical cable has an air content of greater than 40%. In some embodiments, the dielectric film may have an effective dielectric constant of less than about 2, or less than about 1.7, or less than about 1.6, or less than about 1.5, or less than about 1.4, or less than about 1.3, or less than about 1.2. In some embodiments, an effective dielectric constant of an electrical cable constructed using the structured dielectric film described herein for at least one pair of adjacent conductors driven with differential signals of equal amplitude and opposite polarities is less than about 2.5, or less than about 2.2, or less than about 2, or less than 1.7, or less than about 1.6, or less than about 1.5, or less than about 1.4, or less than about 1.3, or less than about 1.2.

The conductors used in the electrical cable may include any suitable conductive material, such as an elemental metal or a metal alloy (e.g., copper or a copper alloy), and may have a variety of cross sectional shapes and sizes. For example, in cross section, the conductors may be circular, oval, rectangular or any other shape. One or more conductors in a cable may have one shape and/or size that differs from other one or more conductors in the cable. The conductors may be solid or stranded wires. All the conductors in a cable may be stranded, all may be solid, or some may be stranded and some solid. Stranded conductors and/or ground wires may take on different sizes and/or shapes. The conductors may be coated or plated with various metals and/or metallic materials, including gold, silver, tin, and/or other materials.

In some embodiments, an electrically conductive shield may be layered, wrapped, or otherwise placed around the structured dielectric film and conductors. The shield may include an electrically conductive shielding layer disposed on an electrically insulative substrate layer. In some embodiments, the shield may include a first shield disposed on a top side of the electrical cable and a second shield disposed on a bottom side of the electrical cable.

FIG. 1 is a cross-sectional view of an electrical cable in accordance with an embodiment of the present description. An electrical cable 100 is shown in an unfolded state, including a dielectric film 10, and a plurality of substantially parallel conductors 40 extending along a length (e.g., in the x-direction of FIG. 1, extending into the page) of the cable 100 and generally lying in a plane of the conductors 40. The dielectric film 10 includes a plurality of structures 20 arranged in pairs of structures 22. Please note that the reference designator 22 without a corresponding letter shall be used to refer generally to pairs of structures within the text of the specification, but each pair of structures shall be shown in the figures with a corresponding letter to refer to a specific pair of structures. For example, referring to FIG. 1, components 22*a* and 22*a*' are used to designate a specific pair of structures. Similarly, 22*b* and 22*b*', and 22*c* and 22*c*' are used to designated two additional specific pairs of structures. When the dielectric film 10 is folded along a longitudinal fold line 15, the structures 20 in each pair of structures 22 face, and are aligned with, each other, and each conductor 40 of the plurality of conductors 40 is disposed between the structures 20 in a corresponding pair of structures 22 (for example, structure 22*c*' will be positioned directly above structure 22*c* when the dielectric film 10 is folded along line 15. This will be described in additional detail in FIG. 2. Returning to FIG. 1, in some embodiments, the electrical cable 100 further includes a conductive shield 50, which may be disposed on a surface of the dielectric film 10. In some embodiments, the dielectric film 10 and/or structures 20 may be made of a material which has a low effective dielectric constant and/or a low dielectric loss. For example, the dielectric film 10 and structures 20 may have a high air content to provide the low effective dielectric constant. For example, the dielectric material may be a single-layer or multi-layer film, or may be a foam material. Air voids may be engineered, machined, formed, or otherwise included within the dielectric material to decrease the dielectric constant of the resulting cable. In some embodiments, the dielectric film 10 and structures 20 may be formed in a single manufacturing process from the same material, while in other embodiments, the dielectric film 10 and structures 20 may be made in separate manufacturing processes and/or made of different materials.

Figure 2:
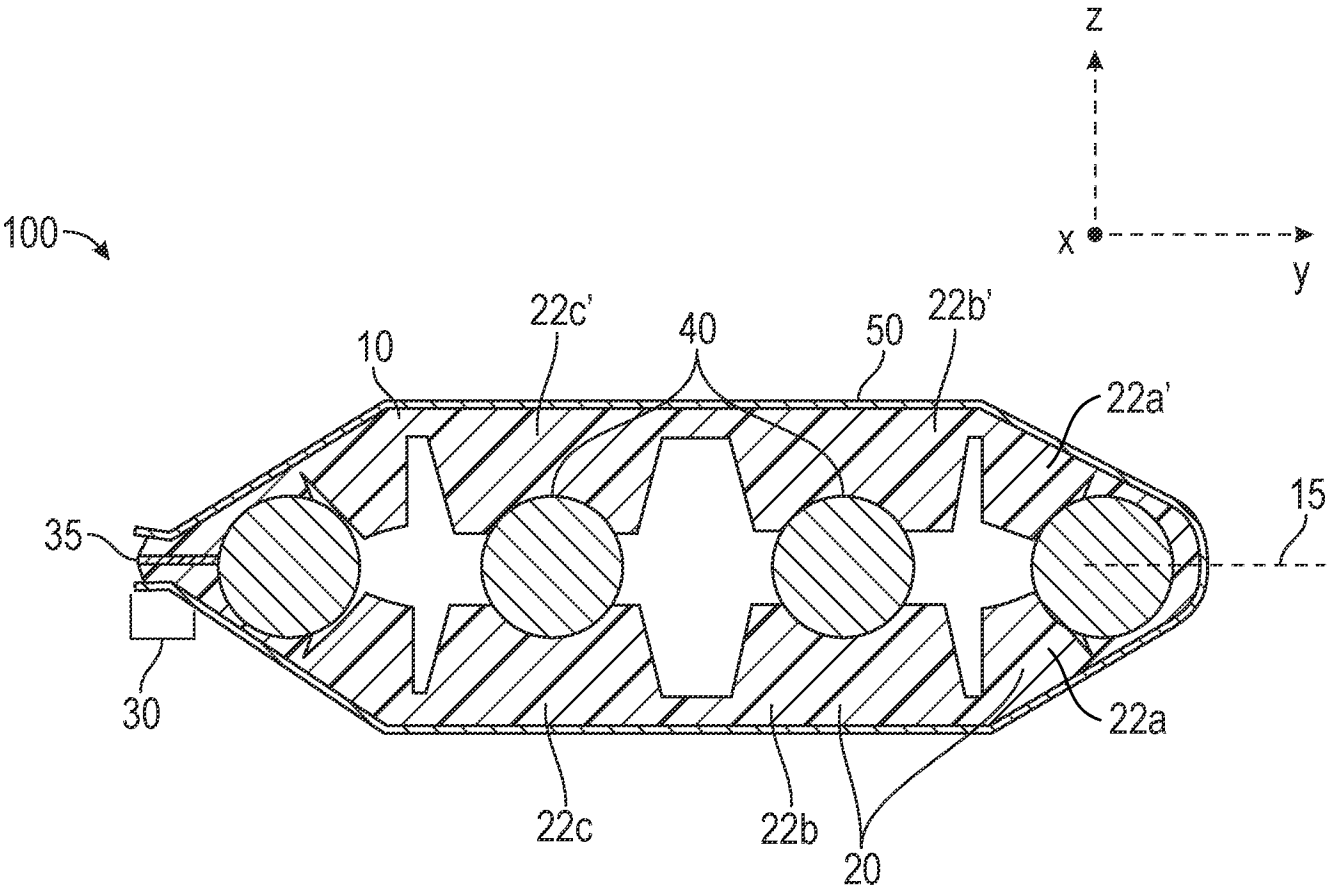
FIG. 2 is a cross-sectional view of an electrical cable.

FIG. 2 is a cross-sectional view of the electrical cable of FIG. 1, now in its final, folded form. An electrical cable 100 includes a dielectric film 10, and a plurality of substantially parallel conductors 40 extending along a length (e.g., in the x-direction of FIG. 2, extending into the page) of the cable 100 and generally lying in a plane of the conductors 40. The dielectric film 10 includes a plurality of structures 20 arranged in pairs of structures 22. The dielectric film 10 has been folded upon itself along longitudinal fold line 15, causing the structures 20 in each pair of structures 22 to face, and be aligned with, each other. Each conductor 40 of the plurality of conductors 40 is disposed between the structures 20 in a corresponding pair of structures 22. For example, one conductor 40 is disposed between structure 22*c* and 22*c*', and another conductor 40 is disposed between structure 22*b* and 22*b*'. In the folded form of FIG. 2, the dielectric film 10 has a pinched portion 30 on one lateral side of the cable, and the longitudinal fold line 15 on an opposite lateral side of the cable 100. In some embodiments, the electrical cable further includes an adhesive layer 35, which may be disposed within the pinched portion 30. In some embodiments, the electrical cable 100 further includes a conductive shield 50, which may be disposed on a surface of the dielectric film 10, to form the exterior layer of the folded electrical cable 100.

Figure 3:
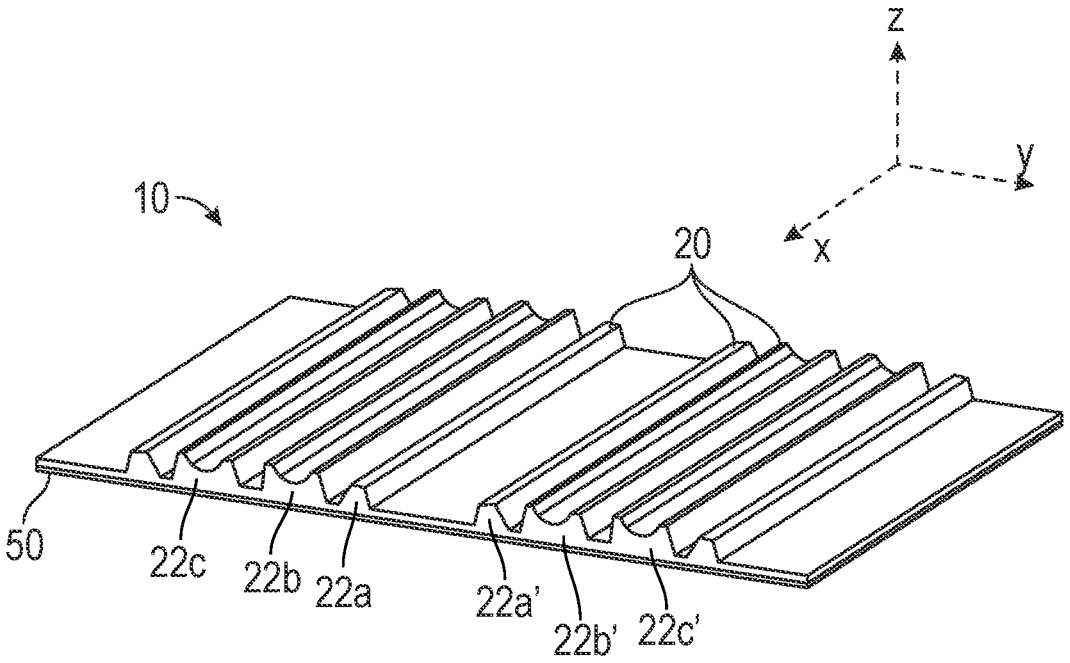
FIG. 3 is a perspective view of a structured dielectric film.

FIGS. 3-6 provide perspective views of embodiments of a dielectric film such as the dielectric film 10 of the electrical cable 100 of FIGS. 1 and 2. FIG. 3 illustrates an example embodiment where the structures 20 in each pair of structures 22 (including pairs 22*a*/22*a*', 22*b*/22*b*', and 22*c*/22*c*') extend substantially the length (e.g., in the x-direction of FIG. 3) of the dielectric film 10. In the example of FIG. 3, a single pair of structures 20 is sufficient to support each conductor (40, FIG. 2), allowing the electrical cable to have structural integrity (e.g., crush resistance) while still allowing a high air content within the cable.

Figure 4:
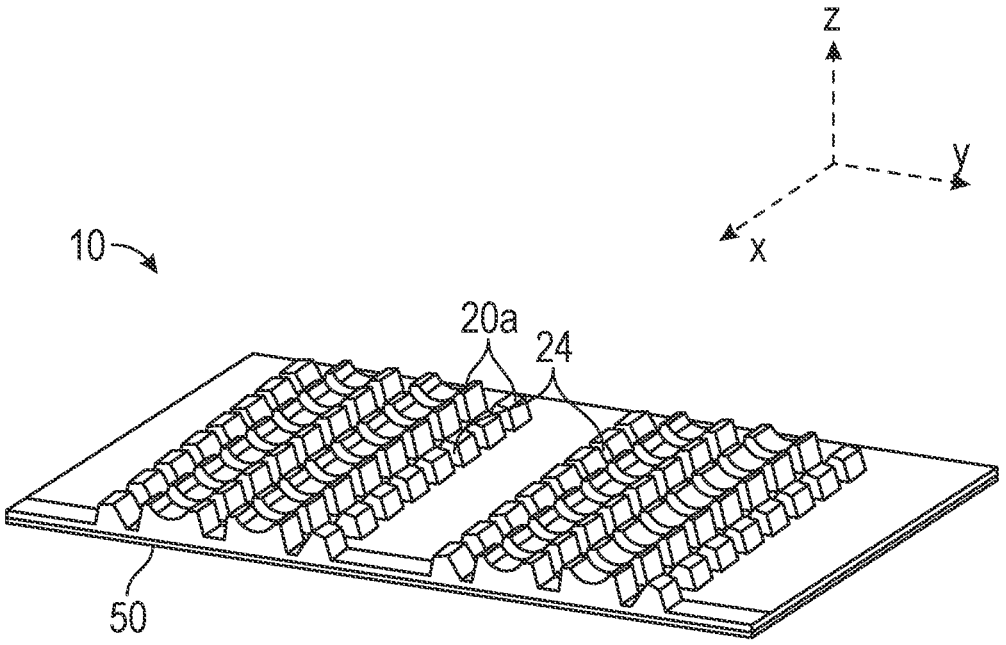
FIG. 4 is a perspective view of a structured dielectric film.

FIG. 4 illustrates an example embodiment of the dielectric film 10 where each structure in each pair of structures (such as pair of structures 22 of FIG. 3) includes a plurality of structure segments 20*a* separated by air gaps 24 along the length of the dielectric film 10. The spacing of air gaps 24 may be a regular or an irregular spacing. The inclusion of air gaps 24 can be used to increase the air content of the electrical cable while still maintaining sufficient cable integrity.

Figure 5:
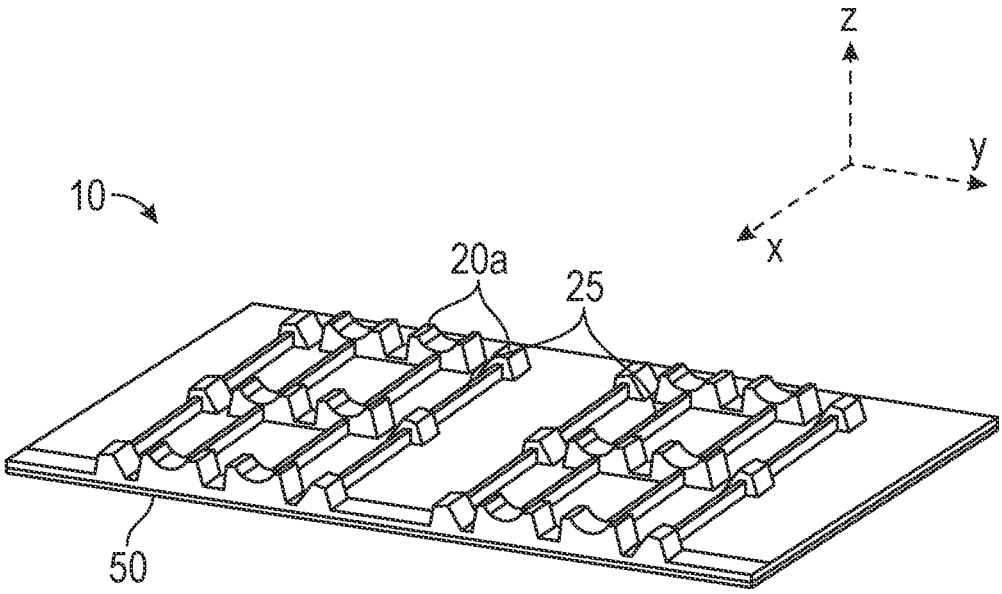
FIG. 5 is a perspective view of a structured dielectric film.

FIG. 5 illustrates an example embodiment of the dielectric film 10 where the air gaps of FIG. 4 further include longitudinal ribs 25 disposed between successive structure segments 20*a*. In some embodiments, the longitudinal ribs 25 provide additional structural support under externally applied loads, such as bending of the cable, but may be smaller than full-length structures 20 such as those of FIG. 3 to allow for increased air content.

Figure 6:
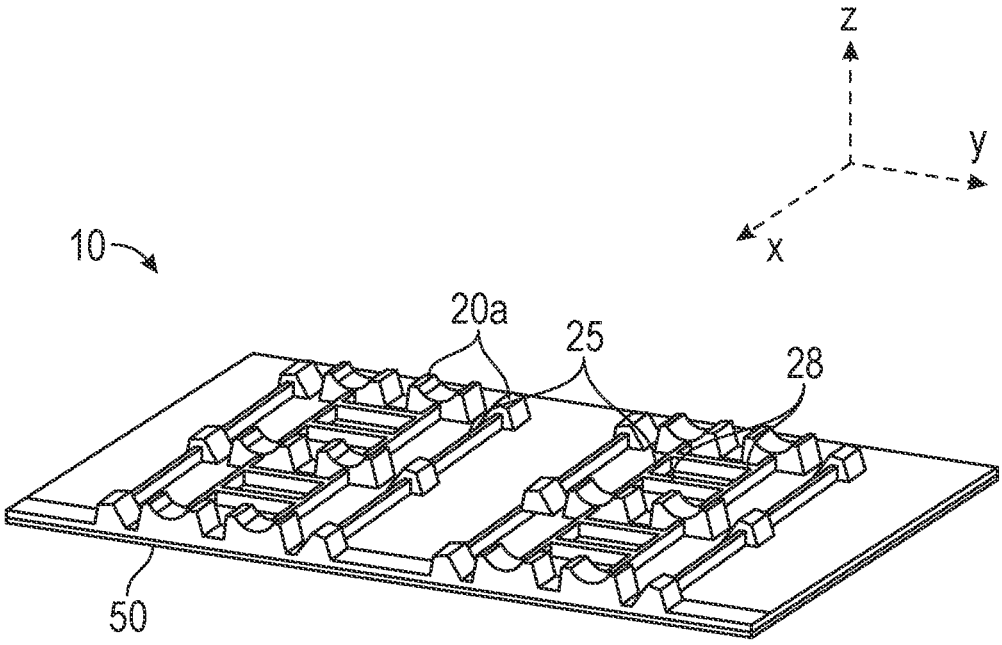
FIG. 6 is a perspective view of a structured dielectric film.

FIG. 6 illustrates an example embodiment of the dielectric film 10 of FIG. 5, where the dielectric film 10 further includes lateral ribs 28 extending between adjacent longitudinal ribs 25. In some embodiments, such as the embodiment of FIG. 3 including full-length structures 20, lateral ribs 28 may also extend between adjacent structures 20. The inclusion of lateral ribs 28 can further increase the structural integrity of an electrical cable.

FIGS. 7A-7C illustrate cross-sectional views of the support structures 20 of a structured dielectric film 10, showing how variations in the surface of the structures 20 can increase the air content in the areas immediately adjacent to the conductors. FIGS. 7B and 7C illustrate two different, example embodiments where at least one structure 20 in at least one pair of structures 22 includes a substructure 37 designed to increase an air content of the at least one structure 20. The shape of the substructure 37 may be any appropriate shape designed to introduce air into the structure 20, including but not limited to triangular notches, square channels, rounded channels, rectangular slots, and/or holes of any appropriate shape.

Figure 8A:
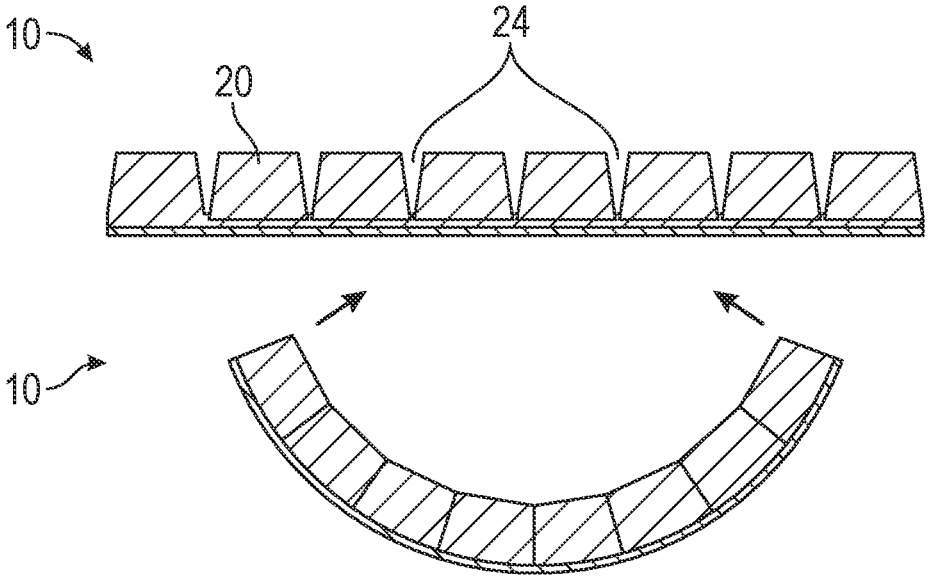
FIG. 8A is a side view of the support structures of a structured dielectric film.

FIG. 8A is a side view of the support structures 20 of a structured dielectric film 10, in both an unbent (top of FIG. 8A) and bent (bottom of FIG. 8A) configuration. In the embodiment of FIG. 8A, a plurality of air gaps 24 has been incorporated into the structures 20. As described elsewhere, these air gaps 24 may increase the air content of the resulting electrical cable, but an additional purpose may also be achieved in some embodiments. The design of the air gaps 24 is such as to create a uniform bend radius for the resulting cable, which may result in a more uniform electrical performance under bending conditions. In the example of FIG. 8A, the design of air gaps 24 is of a triangular notch, but any appropriate shape or design may be used for air gaps 24 to achieve the desired bend radius.

Figure 8B:
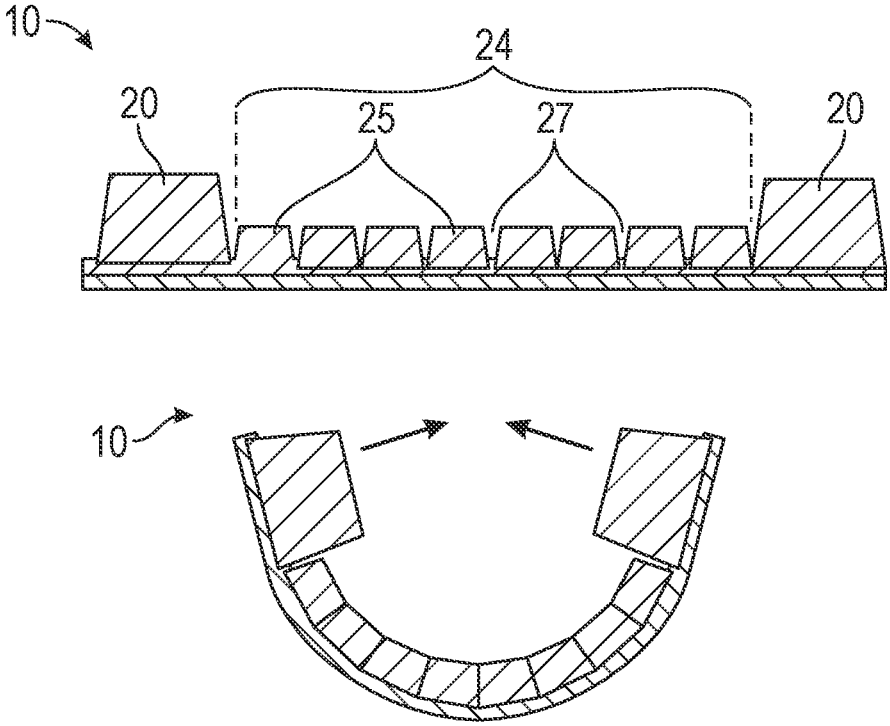
FIG. 8B is a side view of the support structures and longitudinal ribs of a structured dielectric film.

FIG. 8B is a side view of the support structures 20 and air gap 24 including longitudinal ribs 25 of a structured dielectric film 10, in both an unbent (top of FIG. 8B) and bent (bottom of FIG. 8B) configuration. Longitudinal ribs 25 are disposed within air gaps 24. In the embodiment shown, air gaps 24 are a first set of air gaps, and the longitudinal ribs 25 include a second set of air gaps 27. Second set of air gaps 27 is introduced into the longitudinal ribs 25. The design of the second set of air gaps 27 is such as to create a uniform bend radius for the cable, which may result in a more uniform electrical performance under bending conditions. The design of second set of air gaps 27 is shown as a triangular notch in FIG. 8B, but any appropriate shape or design may be used for air gaps 27 to achieve the desired bend radius.

One potential performance artifact of creating a regular pattern of structure segments and air gaps is that the repeated dielectric structure could give rise to unwanted resonance that could interfere with transmitting the high-speed data signal. If this occurred, certain design strategies may provide mitigation of the resonance effect, in some embodiments. For example, varying the support size (e.g., the length of the support segments in the longitudinal dimension of the electrical cable), or varying the spacing of the support segments may help mitigate resonance effects. In addition, if the support segment and the air gaps between them are designed to be smaller relative to the effective wavelength of the signal, the effect may be minimized or eliminated.

Figure 9:
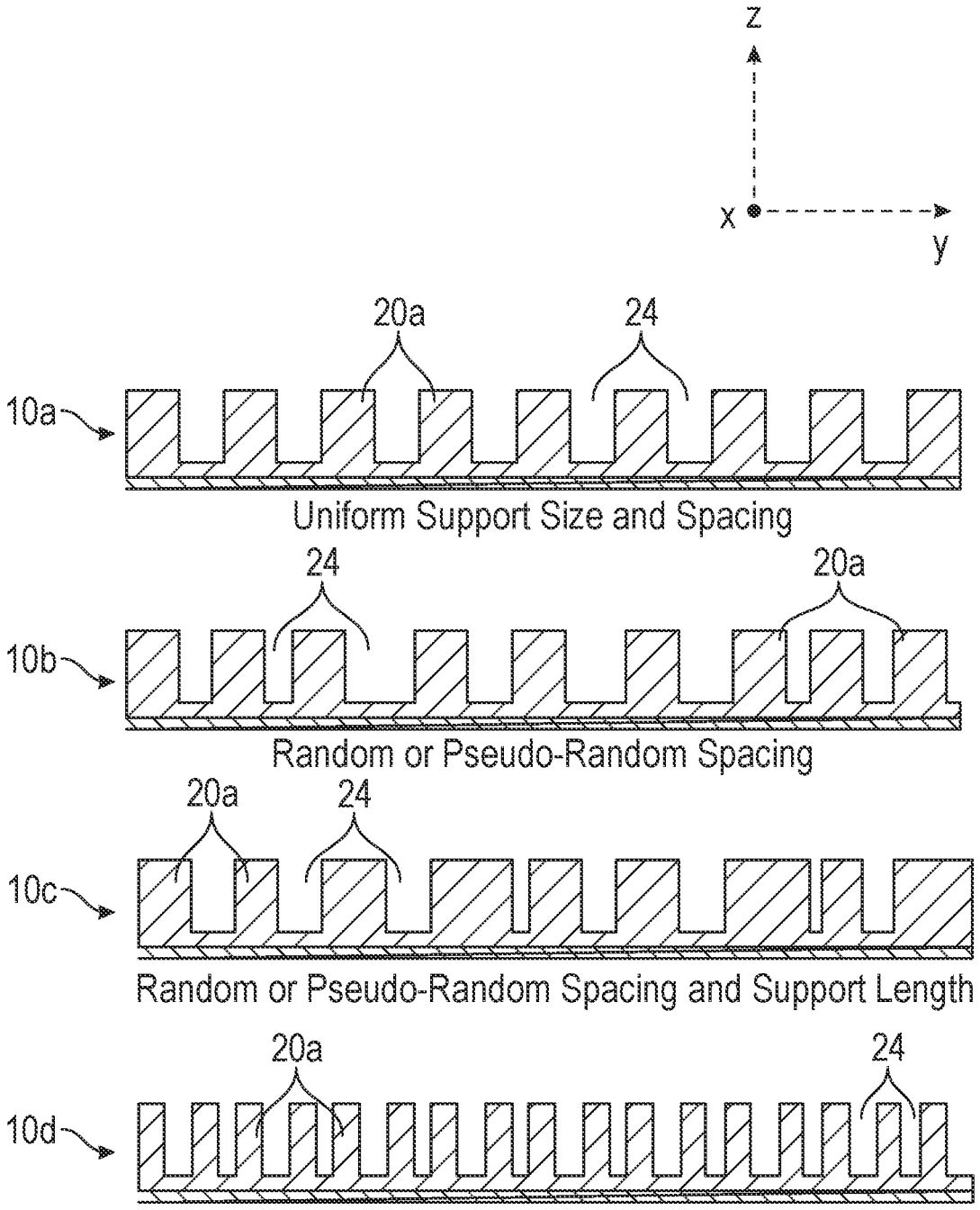
FIG. 9 illustrates how various spacings and support lengths can be used in a structured dielectric film.

FIG. 9 illustrates how various spacings and support segment lengths can be used in a structured dielectric film, both to manage the air content in a cable and to mitigate resonance issues. FIG. 9 shows four example dielectric films 10*a*, 10*b*, 10*c*, and 10*d*, each using different lengths and spacing schemes for support segments 20*a*. In the example of dielectric film 10*a*, a spacing of the structure segments along the length of the cable is a regular spacing, and the length of the support segments 20*a* (e.g., the length of support segments 20*a* in the X direction of FIG. 9) is consistent throughout the length of film 10*a*. In the example of dielectric film 10*b*, the length of the support segments 20*a* remains consistent, but the spacing of the structure segments 20*a* along the length of the cable is a random or pseudo-random spacing. In example 10*c*, both the spacing and length of the structure segments 20*a* is random or pseudo-random. In example 10*d*, the length of the support segments 20*a* and air gaps 24 is kept relatively small to help mitigate resonance effects.

Figure 10:
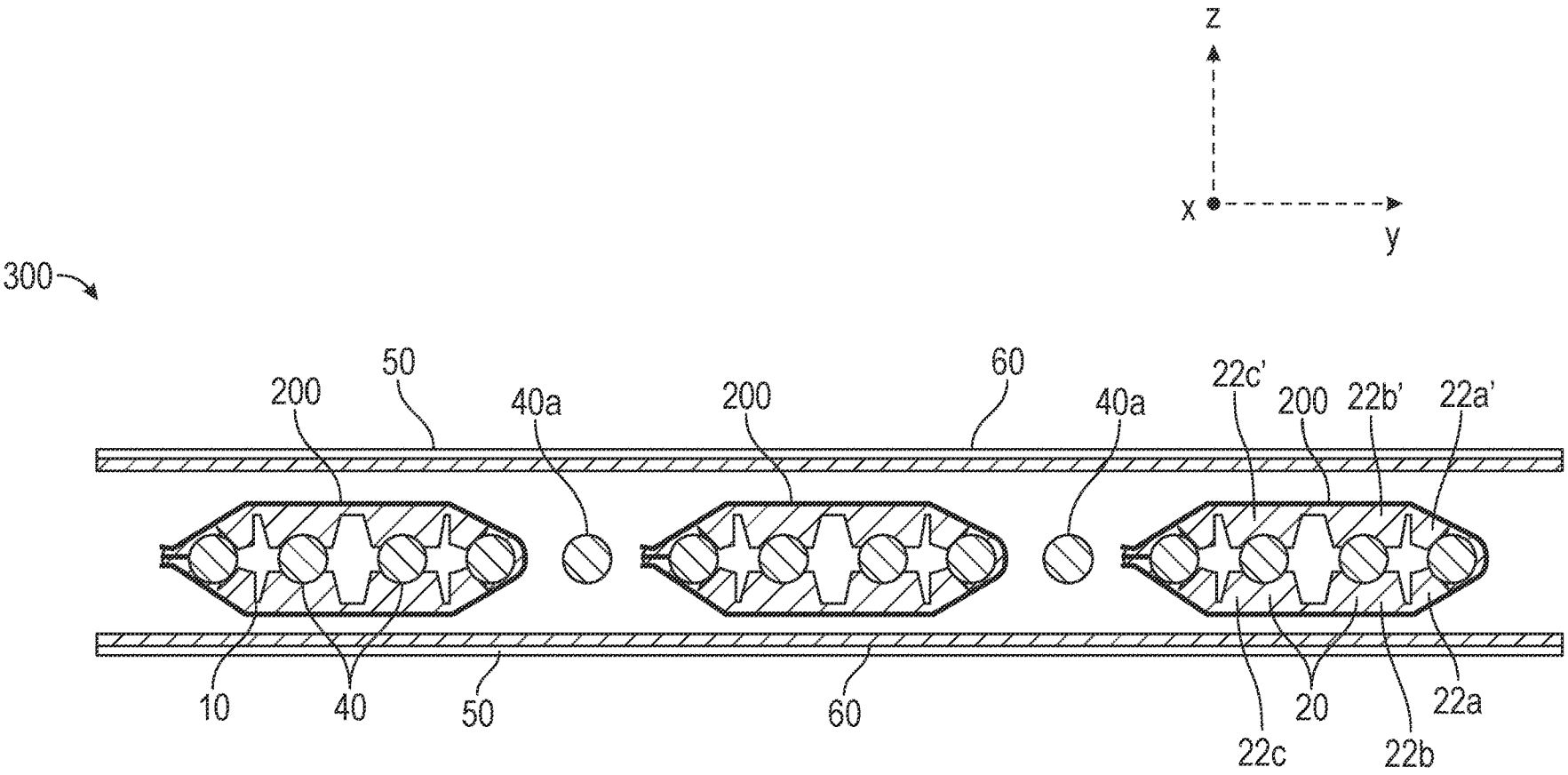
FIG. 10 illustrates a ribbon cable featuring multiple conductor sets.

FIG. 10 is an exploded view of an embodiment of a ribbon cable featuring multiple conductor sets. A ribbon cable 300 includes a plurality of conductor sets 200 extending along a length of the ribbon cable and generally lying in a plane of the ribbon cable, a first bonding film 60 disposed on a top side of the plurality of conductor sets 200, and a second bonding film 60 disposed on a bottom side of the plurality of conductor sets 200, the first bonding film 60 bonded to the second bonding film 60 such that the plurality of conductor sets 200 is captured between and substantially surrounded by the first bonding film 60 and second bonding film 60. In some embodiments, conductor set 200 may be electrical cable 100 of, for example, FIG. 2. Each conductor set 200 may include a plurality of substantially parallel conductors 40 extending along a length (e.g., direction X as shown in FIG. 10, extending into the page) of the conductor set 200 and generally lying in a plane of the conductors, and a dielectric film 10 comprising a plurality of pairs of structures 20 and folded upon itself along a longitudinal fold line so that the structures in each pair of structures face, and are aligned with, each other. Each conductor 40 of the plurality of conductors 40 is disposed between the structures 20 of a single corresponding pair of structures 22 (for example, pair 22*c*/22*c*'). In some embodiments, the first bonding film 60 and the second bonding film 60 are constructed of a dielectric material. In some embodiments, the first bonding film and the second bonding film may further include a conductive shield 50. In some embodiments, ribbon cable 300 may further include at least one single conductor 40*a* not part of the plurality of conductor sets 200. Single conductors 40*a* may or may not be individually insulated and/or shielded.

Figure 11:
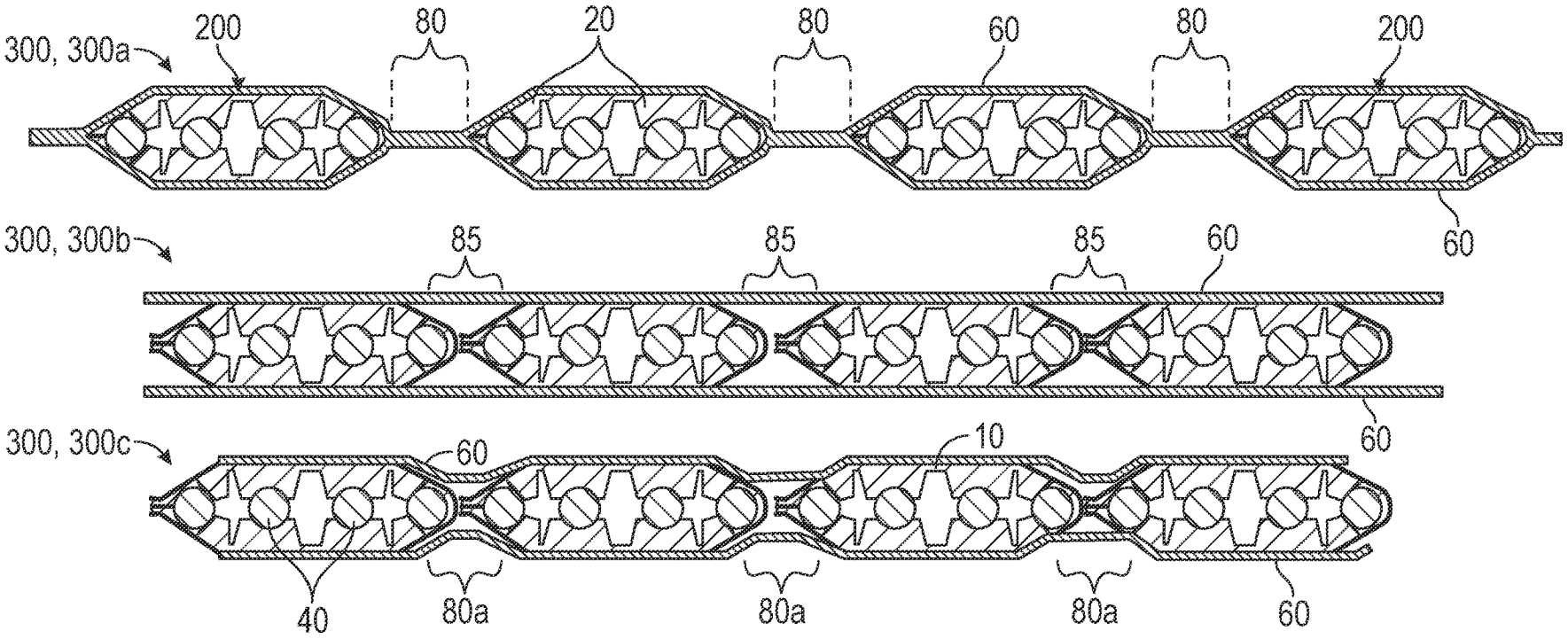
FIG. 11 illustrates various embodiments of a ribbon cable featuring multiple conductor sets.

FIG. 11 illustrates various embodiments of a ribbon cable featuring multiple conductor sets. FIG. 11 provides three example embodiments of a ribbon cable, 300*a*, 300*b*, and 300*c*. In the example of ribbon cable 300*a*, the first bonding film 60 (disposed on a top side of ribbon cable 300*a*) and the second bonding film 60 (disposed on a bottom side of ribbon cable 300*a*) form pinched portions 80 in ribbon cable 300*a* between adjacent conductor sets 200. In some embodiments, the pinched portions 80 may serve to isolate the conductor sets 200 from each other. In the example of ribbon cable 300*b*, the first bonding film 60 (*top*) and the second bonding film 60 (bottom) provide sections containing air voids 85 in ribbon cable 300*b* between adjacent conductor sets 200, which may contribute to a decrease in the dielectric constant of ribbon cable 300*b*. As shown in the example of ribbon cable 300*c*, a combination 80*a* of pinched portions and air voids can be used to create ribbon cables 300*c* with the desired electrical and structural properties.

Figure 12:
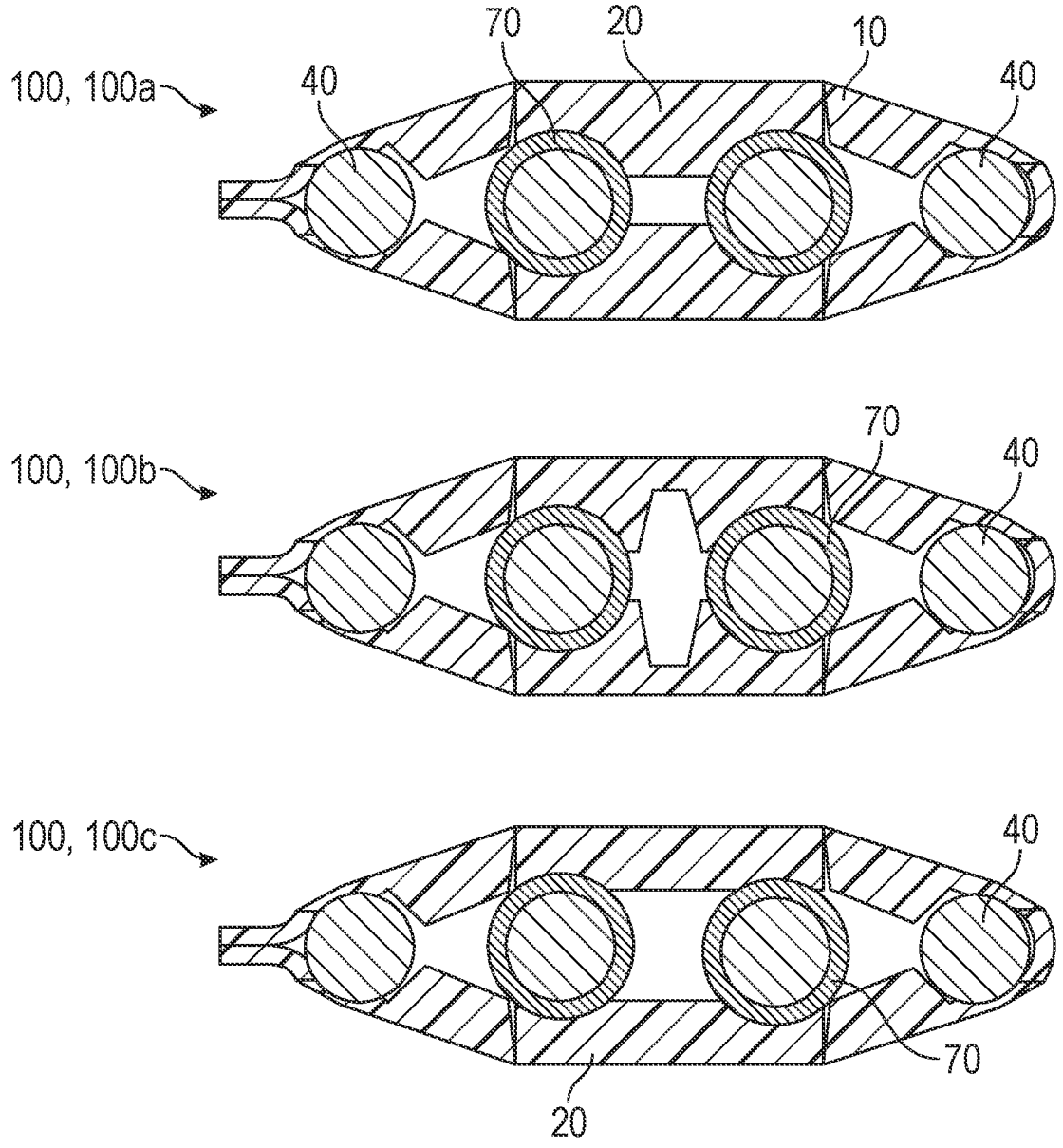
FIG. 12 is a cross-sectional view of an electrical cable illustrating a heat bondable surface coating on the conductors.

FIG. 12 is a cross-sectional view of various embodiments of an electrical cable where the conductors include a heat bondable surface coating. FIG. 12 presents three different electrical cable embodiments, 100*a*, 100*b*, and 100*c*. Each example embodiment shows four conductors 40, although any appropriate number of conductors 40 may be used, including, but not limited to, 1, 2, 4, 6, 8, 12, and 20. Each configuration 100*a*-100*c* illustrates a surface coating 70 on two of the conductors 40. In some embodiments, this surface coating 70 may be a heat bondable insulator that is applied prior to passing the electrical cables 100 through a lamination or folding process. In some embodiments, the surface coating 70 is designed to create a bond between the conductors 40 and the structured dielectric film 10, and, in particular, between the supports 20 and the conductors 40. The surface coating 70 may be a single layer, or it may be any appropriate number of layers, including, but not limited to, 2, 4, and 6 layers. In some embodiments, the surface coating 70 is a heat bondable insulator, and a bond is created during assembly of the electrical cable 100 through heat seal bonding or another appropriate means. In some embodiments, the surface coating 70 may be applied only to certain conductors 40, while other conductors 40 may remain uncoated. For example, the surface coating 70 may have insulating properties which may isolate the coated conductors 40 electrically and protect the conductors 40 from environmental exposure. Conductors 40 may use insulation for a variety of purposes, including electrically isolating a conductor from another conductor or surface, protection against environmental threats (such as moisture), protection against physical damage, resisting electrical leakage, etc. In some example embodiments, a first set of conductors may be insulated, while a second set of conductors may be uninsulated.

FIG. 12 also illustrates that a variety of shapes and sizes may be used in the design of the structures 20. For example, electrical cables 100*a* and 100*c* show examples where a single, continuous structure 20 may be used for two or more conductors 40, such as the two central, insulated conductors 40 in each example. In the example of 100*c*, the shape of the central structure 20 holding the two central, insulated conductors 40 is essentially flat, and lateral movements are prevented more from the heat bondable surface coating 70 than due to the shape or configuration of the structures 20.

Figure 13:
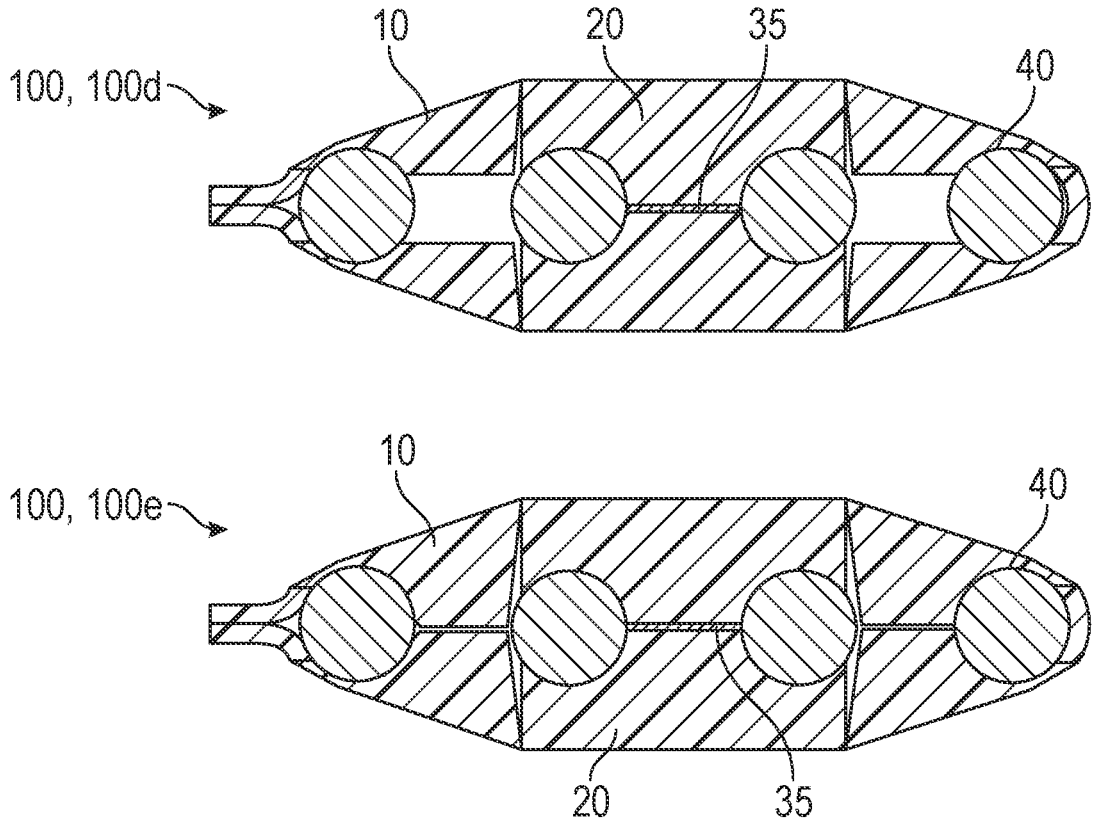
FIG. 13 is a cross-sectional view of an electrical cable.
Figure 14:
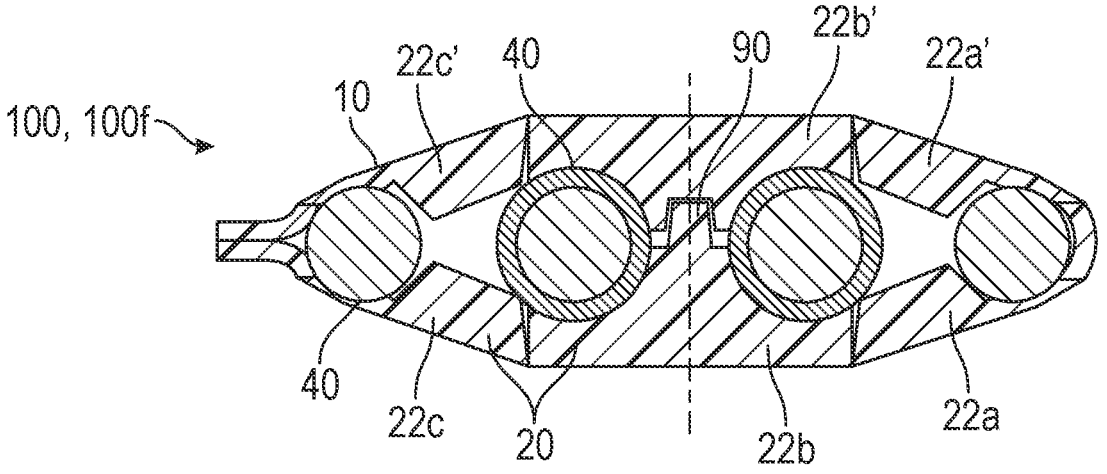
FIG. 14 is a cross-sectional view of an electrical cable.

FIGS. 13-14 illustrate cross-sectional views of three example embodiments of an electrical cable 100. Turning to FIG. 13, example embodiments 100*d* and 100*e* feature larger supports 20, where the supports 20 extend down and up between the centermost conductors 40 until they contact each other. In some embodiments, an adhesive layer 35 is applied at the point between conductors 40 where the upper and lower structures 20 come in contact. The embodiment shown in example 100*e* substantially surrounds conductors 40 with dielectric material from structures 20 of dielectric film 10, while example 100*d* leaves air voids within the electrical cable 100*d*. FIG. 14 is a cross-sectional view of an example embodiment of an electrical cable 100*f*, where at least one structure 20 in at least one pair of structures 22 (for example, pair 22*b*/22*b*' in FIG. 14) includes a mechanical interference feature 90. In some embodiments, the purpose of the mechanical interference feature 90 is to more firmly connect the upper structure 20 to the lower structure 20 and to further prevent relative lateral movements of the conductors 40 and structures 20. As with examples 100*d* and 100*e* of FIG. 13, an adhesive layer 35 may be disposed between one or more contacting surfaces of structures 20, or between structures 20 and one or more conductors 40.

Figure 15:
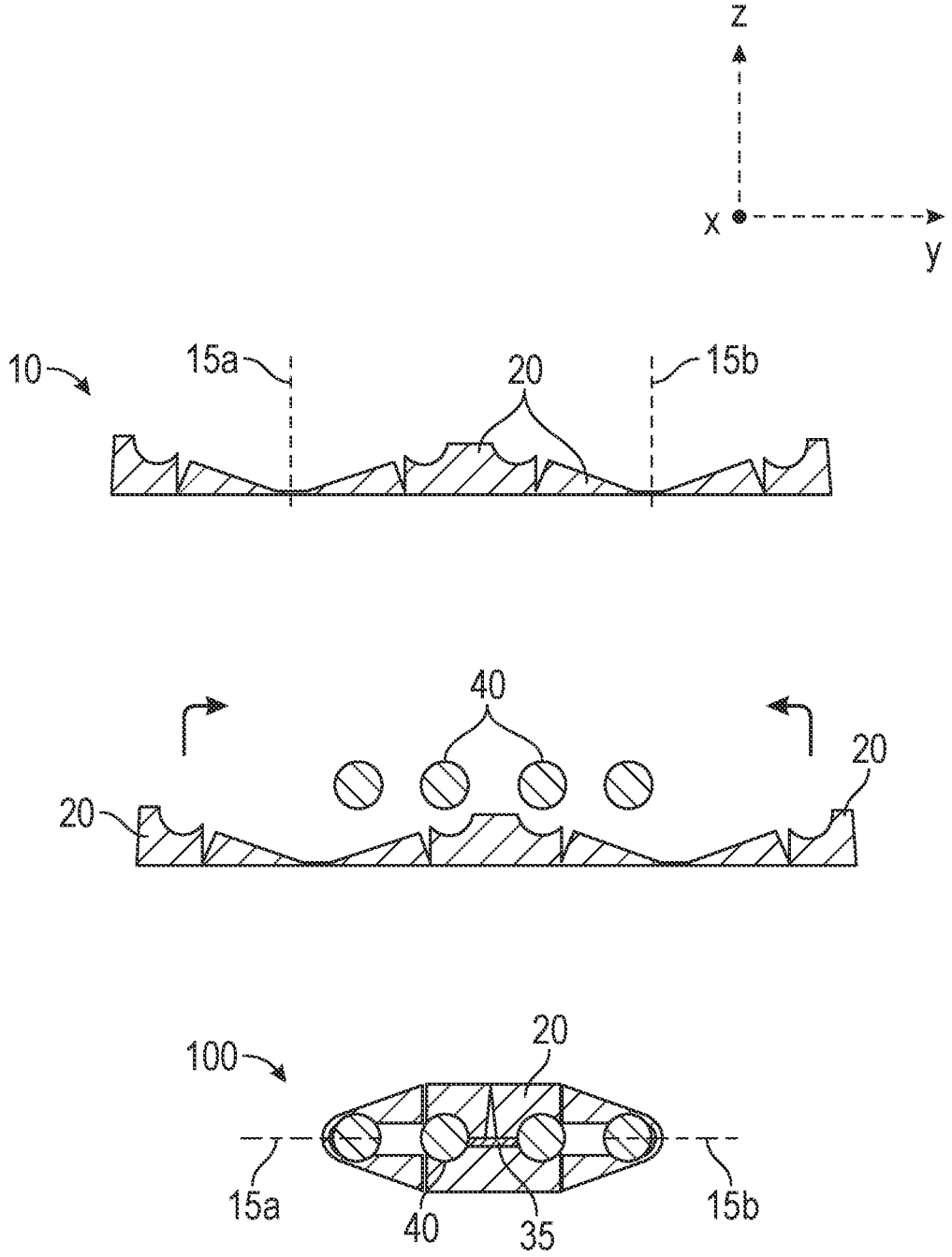
FIG. 15 is an exploded, cross-sectional view of an electrical cable.

FIG. 15 is a cross-sectional view of an electrical cable, along with exploded, cross-sectional views of an alternate embodiment of a structured dielectric film 10 including structures 20. In the embodiment shown in FIG. 15, the dielectric film 10 exhibits a first longitudinal fold line 15*a* located on one lateral side of the dielectric film 10, and a second longitudinal fold line 15*b* on the opposite lateral side of the dielectric film 10. That is, when assembled (i.e., folded), there is a first longitudinal fold line 15*a* located on one lateral side of the cable 100, and the dielectric film 10 is further folded upon itself along a second longitudinal fold line 15*b* on an opposite lateral side of the cable 100. This example design has the effect of creating a more symmetrical final electrical cable 100, avoiding the one-sided pinched portion such as that shown in the example embodiment of FIG. 2. As with other designs, an adhesive layer 35 may be disposed between contacting surfaces of structures 20, or between structures 20 and at least one conductor 40.

Figure 16B:
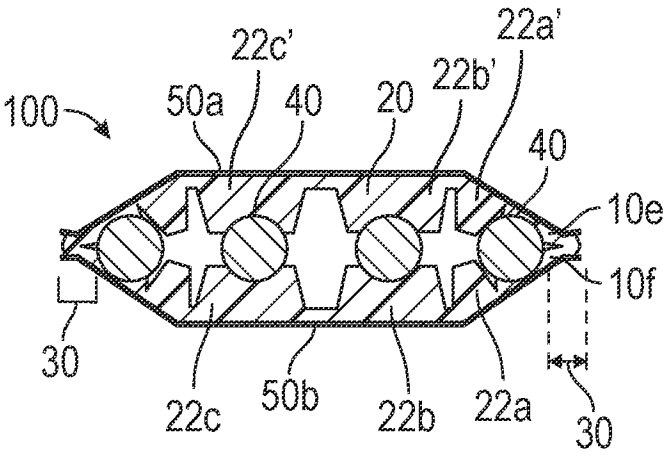
FIGS. 16A-16B are cross-sectional views of an electrical cable with top and bottom structured dielectric films.
Figure 16A:
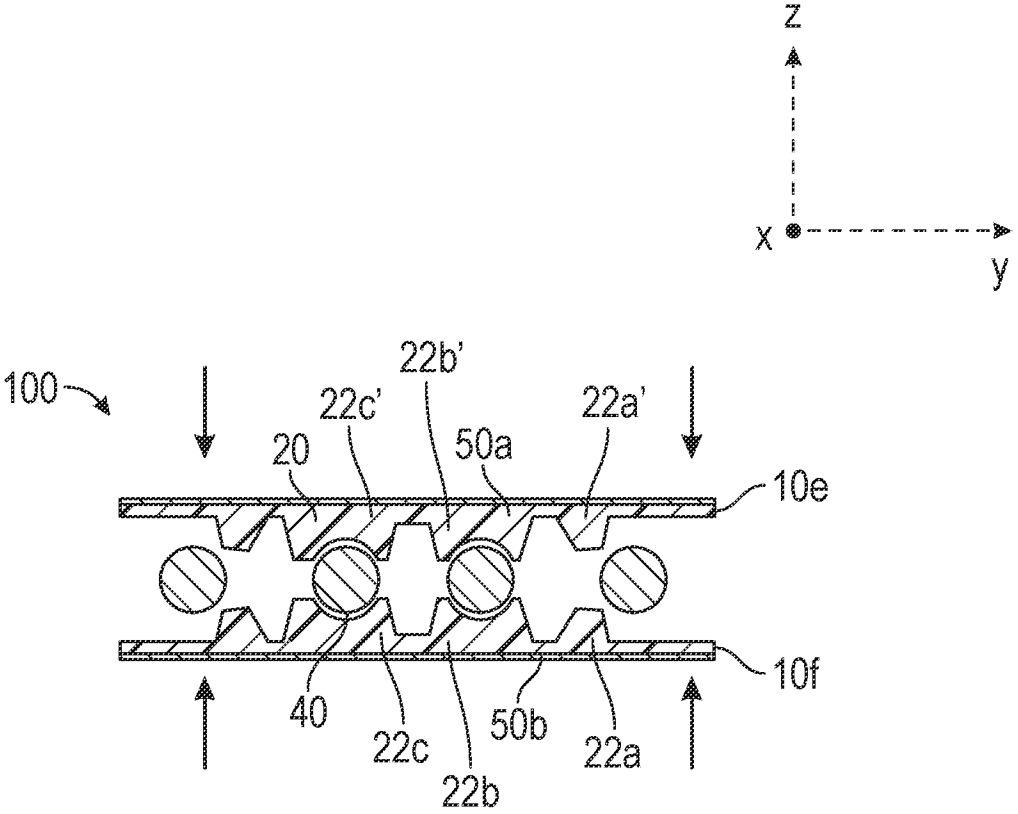

FIGS. 16A-16B are cross-sectional views of an electrical cable with top and bottom structured dielectric films. Looking at FIGS. 16A and 16B together, a cable includes a plurality of substantially parallel conductors 40 extending along a length of the cable (e.g., direction X in FIGS. 16A and 16B, extending into the page) and generally lying in a plane of the conductors, a first dielectric film 10*a* comprising a first plurality of structures 20, and a second dielectric film 10*b* comprising a second plurality of structures 20. The second dielectric film 10*b* is disposed on and substantially co-extensive with the first dielectric film 10*a*, such that each structure 20 in the first plurality of structures 20 faces and is substantially aligned with a corresponding structure 20 in the second plurality of structures 20 to create pairs of structures 22, each conductor 40 of the plurality of conductors 40 disposed between the structures 20 in each pair of structures 22, where the structures 20 in each pair of structures 22, in combination, cover at least 40% of a periphery of the corresponding conductor 40. For example, the structures 20 of pair 22*c*/22*c*' may together cover at least 40% of the conductor 40 disposed between them. When assembled, as shown in FIG. 16*b*, a pinched portion 30 may appear on both lateral sides of electrical cable 100, and no longitudinal fold lines are present.

The structures 20 in each pair of structures 22, in combination, substantially prevent any lateral movement of the conductor 40 in relation to the structures 22. This may be achieved by designing structures 20 with features (e.g., grooves or channels) which conform to the periphery of conductors 40, through the use of an adhesive layer (not shown) disposed between corresponding structures 20 or between structures 20 and conductors 40, by mechanical friction (i.e., for example, pressure provided by pair of structures 22*b*/22*b*' to the surface of the conductor 40 disposed between them), or by any appropriate means. In some embodiments, the first dielectric film 10*a* may be thermally bonded to the second dielectric film 10*b*. In some embodiments, at least one of the first dielectric film 10*a* and the second dielectric film 10*b* are thermally bonded to at least one of the conductors 40. In some embodiments, the cable 100 may further include an adhesive layer (not shown) disposed between the first dielectric film 10*a* and the second dielectric film 10*b*, or between conductors 40 and the first dielectric film 10*a* and second dielectric film 10*b*. In some embodiments, the electrical cable 100 may further include a conductive shield 50 which substantially surrounds and encloses cable 100. In some embodiments, the conductive shield may consist of a first conductive shield layer 50*a* and a second conductive shield layer 50*b*.

Terms such as "about" will be understood in the context in which they are used and described in the present description by one of ordinary skill in the art. If the use of "about" as applied to quantities expressing feature sizes, amounts, and physical properties is not otherwise clear to one of ordinary skill in the art in the context in which it is used and described in the present description, "about" will be understood to mean within 10 percent of the specified value. A quantity given as about a specified value can be precisely the specified value. For example, if it is not otherwise clear to one of ordinary skill in the art in the context in which it is used and described in the present description, a quantity having a value of about 1, means that the quantity has a value between 0.9 and 1.1, and that the value could be 1.

Terms such as "substantially" will be understood in the context in which they are used and described in the present description by one of ordinary skill in the art. If the use of "substantially equal" is not otherwise clear to one of ordinary skill in the art in the context in which it is used and described in the present description, "substantially equal" will mean about equal where about is as described above. If the use of "substantially parallel" is not otherwise clear to one of ordinary skill in the art in the context in which it is used and described in the present description, "substantially parallel" will mean within 30 degrees of parallel. Directions or surfaces described as substantially parallel to one another may, in some embodiments, be within 20 degrees, or within 10 degrees of parallel, or may be parallel or nominally parallel. If the use of "substantially aligned" is not otherwise clear to one of ordinary skill in the art in the context in which it is used and described in the present description, "substantially aligned" will mean aligned to within 20% of a width of the objects being aligned. Objects described as substantially aligned may, in some embodiments, be aligned to within 10% or to within 5% of a width of the objects being aligned.

All references, patents, and patent applications referenced in the foregoing are hereby incorporated herein by reference in their entirety in a consistent manner. In the event of inconsistencies or contradictions between portions of the incorporated references and this application, the information in the preceding description shall control.

Descriptions for elements in figures should be understood to apply equally to corresponding elements in other figures, unless indicated otherwise. Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

What is claimed is:

1. A cable, comprising:

a plurality of substantially parallel conductors extending along a length of the cable and generally lying in a plane of the conductors; and a dielectric film comprising a plurality of pairs of structures and folded upon itself along a longitudinal fold line so that structures in each pair of structures face, and are aligned with, each other, each conductor of the plurality of conductors disposed between and held by the structures in a single corresponding pair of structures, and each conductor of the plurality of conductors disposed between and held by a different single pair of structures, wherein at least one structure in the single pair of structures comprises a substructure designed to increase an air content of the at least one structure.

2. The cable of claim 1, wherein the dielectric film has a pinched portion on one lateral side of the cable, and the longitudinal fold line on an opposite lateral side of the cable.

3. The cable of claim 1, wherein the longitudinal fold line is a first longitudinal fold line located on one lateral side of the cable, and the dielectric film is further folded upon itself along a second longitudinal fold line on an opposite lateral side of the cable.

4. The cable of claim 1, wherein the structures in each pair of structures extend substantially the length of the dielectric film.

5. The cable of claim 1, wherein each structure in each pair of structures comprises a plurality of structure segments separated by air gaps along the length of the dielectric film.

6. The cable of claim 5, wherein the air gaps further comprise longitudinal ribs disposed between successive structure segments.

7. The cable of claim 6, wherein the air gaps are a first set of air gaps, and the longitudinal ribs comprise a second set of air gaps.

8. The cable of claim 7, wherein a design of the second set of air gaps is such as to create a uniform bend radius for the cable.

9. The cable of claim 5, wherein a design of the air gaps is such as to create a uniform bend radius for the cable.

10. The cable of claim 1, wherein the dielectric film further comprises lateral ribs extending between adjacent structures.

11. The cable of claim 1, wherein the conductors comprise a heat bondable surface coating.

12. The cable of claim 1, further comprising a conductive shield.

13. The cable of claim 1, wherein at least one structure in at least one pair of structures comprises a mechanical interference feature.

14. The cable of claim 1, further comprising an adhesive layer.

15. A cable, comprising:

a plurality of substantially parallel conductors extending along a length of the cable and generally lying in a plane of the conductors;

a first dielectric film comprising a first plurality of structures; and a second dielectric film comprising a second plurality of structures, the second dielectric film disposed on and substantially co-extensive with the first dielectric film, such that each structure in the first plurality of structures faces and is substantially aligned with a corresponding structure in the second plurality of structures to create pairs of structures, each conductor of the plurality of conductors disposed between the structures in a single corresponding pair of structures, each conductor of the plurality of conductors disposed between and held by a different single pair of structures, wherein at least one structure in the single pair of structures comprises a substructure designed to increase an air content of the at least one structure, wherein the structures in each pair of structures, in combination, cover at least 40% of a periphery of the conductor.

16. The cable of claim 15, wherein the structures in each pair of structures, in combination, substantially prevent any lateral movement of the conductor in relation to the structures.

17. The cable of claim 15, further comprising a conductive shield.

18. The cable of claim 15, wherein the first dielectric film is thermally bonded to the second dielectric film.

19. The cable of claim 15, wherein at least one of the first dielectric film and the second dielectric film are thermally bonded to at least one of the conductors.

* * * * *